United States Patent [19]

Bartlett et al.

[11] Patent Number: 5,060,481

[45] Date of Patent: Oct. 29, 1991

[54] METHOD AND APPARATUS FOR CONTROLLING A CRYOGENIC REFRIGERATION SYSTEM

[75] Inventors: Allen J. Bartlett, Milford; Maureen C. Buonpane, Lexington; Paul E. Amundsen, Ipswich, all of Mass.

[73] Assignee: Helix Technology Corporation, Waltham, Mass.

[21] Appl. No.: 383,170

[22] Filed: Jul. 20, 1989

[51] Int. Cl.[5] ..... F25B 19/02

[52] U.S. Cl. ..... 62/51.2; 62/85; 62/94; 62/195; 62/275; 62/475; 137/59; 137/341

[58] Field of Search ..... 137/59, 341; 62/51.2, 62/275, 129, 85, 94, 195, 475

[56] References Cited

U.S. PATENT DOCUMENTS

| | | | |
|---|---|---|---|
| 3,314,473 | 4/1967 | Smith et al. | 62/51.2 |
| 3,398,549 | 8/1968 | Zobel | 62/129 |
| 3,933,003 | 1/1976 | Markum | 62/51.2 |
| 4,126,017 | 11/1978 | Bytniewski et al. | 62/51.2 |
| 4,366,680 | 1/1983 | Lovelace | 62/51.2 |
| 4,543,793 | 10/1985 | Chellis et al. | 62/6 |
| 4,614,093 | 9/1986 | Bächler et al. | 62/55.5 |
| 4,653,284 | 3/1987 | Steyert | 62/51.2 |
| 4,679,401 | 7/1987 | Lessard et al. | 62/55.5 |
| 4,757,689 | 7/1988 | Bächler et al. | 62/55.5 |
| 4,766,741 | 8/1988 | Bartlett et al. | 62/514 |
| 4,796,433 | 1/1989 | Bartlett | 62/54 |

*Primary Examiner*—Ronald C. Capossela

*Attorney, Agent, or Firm*—Hamilton, Brook, Smith & Reynolds

[57] ABSTRACT

A cryogenic refrigeration system has a control system that controls the operation of the refrigeration system and provides status information to the operator of the refrigeration system. The cryogenic refrigeration system includes one or more heater and at least one Joule-Thomson valve. The heaters are used to control the recondensing capacity of the refrigeration system and to heat the at least one Joule-Thomson valve and other points to melt away contaminants that may freeze at such points. The control system controls operation of the heaters. The control system also automates an initialization routine that utilizes the heaters to prevent blockage of the valves, and cools the refrigeration system down to a desired temperature. In addition, the control system shuts down the refrigeration system if the status information it monitors exceed a safe range.

35 Claims, 8 Drawing Sheets

METHOD AND APPARATUS FOR CONTROLLING A CRYOGENIC REFRIGERATION SYSTEM

BACKGROUND OF THE INVENTION

Many superconducting devices such as magnetic resonance imaging (MRI) systems use an inventory of liquid cryogen (i.e. helium) for providing the continuous refrigeration necessary to maintain a temperature well suited for superconduction. Typically, a cryostat or vacuum jacketed reservoir of the liquid cryogen is used to cool the device to achieve superconductivity. As the device is used, heat is generated and transferred to the inventory of liquid cryogen. When the liquid cryogen absorbs sufficient heat, it boils resulting in a large portion of the cryogen becoming gaseous. In the case of mobile magnetic resonance imaging (MRI) systems, additional quantities of cryogen are boiled off each time the system is magnetized and demagnetized. It is necessary to demagnetize such devices for every road trip.

In order to maintain and replenish the inventory of liquid cryogen so as to compensate for the boiled-off cryogen, a continuous supply of gaseous cryogen must be provided. This gaseous cryogen must be liquified and introduced into the liquid inventory. To help reduce the amount of cryogen that must be replaced into the system, a means of recondensing the boiled-off cryogen back into the liquid inventory can be used. One means of recondensing the boiled-off cryogen is to collect the venting cryogen gas and direct it to a refrigeration apparatus (cryogenic recondenser) located above the cryostat which recondenses the cryogen. Once the cryogen is recondensed, it is then reintroduced back into the cryostat. A variation on this approach is presented in U.S. Pat. Nos. 4,766,741 and 4,796,433, a transfer line which carries a liquid cryogen (i.e. helium) from a closed cycle refrigeration system is inserted into the cryostat. The gaseous cryogen in the cryostat is cooled by heat exchange with the liquid cryogen in the transfer line to such an extent that it recondenses.

SUMMARY OF THE INVENTION

A cryogenic refrigeration system has a heater connected to a point of the system that is prone to blockage. The heater melts the contaminants that freeze within the system and cause the blockage. One preferable location for such a heater is at a Joule-Thomson valve which is especially prone to blockage. Whether a blockage exists may be determined by a temperature reading at a refrigerator within the system.

It is preferred that the refrigeration system has a plurality of heaters and a plurality of Joule-Thomson valves. Each heater should be connected individually to a separate Joule-Thomson valve. Moreover, it is preferred that at least one of the heaters is adjustable so that the amount of heat it provides can be varied.

In accordance with one embodiment, a plurality of sensors are included within the system. These sensors may be situated at strategic locales within the system to measure the temperature at the locales. In particular, a sensor may be placed at each Joule-Thomson valve and at a refrigerator within the system.

The refrigeration system may be a cryogenic recondenser. The use of helium as the refrigerant allows the system to obtain the extremely low temperatures required to recondense helium in a cryostat.

A control system controls operation of the cryogenic refrigeration system. A major feature of the control system is a heater control means that selectively controls whether at least one heater connected to at least one Joule-Thomson valve is switched on during the cool down routine. Activation of the heater is a function of time and temperature within the system. The control system preferably switches each heater off independently and automatically turns each heater on during an initialization routine. The control system also may control the capacity of the system via a heater.

The system is initialized by opening a bypass valve that accelerates the cooling of the system and by turning on heaters connected to Joule-Thomson valves to prevent the freezing of contaminants.

The control system also includes a display means for displaying relevant status information to the system operator. In particular, it may display status information that is indicative of whether critical environmental conditions are within a specified range. If the conditions are within a cautionary mode range, the display means preferably notes the problem. Further, if the conditions are within a failure mode range, the display means preferably notes the problem and shuts down the system.

Conditions that may be monitored include temperature, cryostat pressure, compressor current and heater status. The status information may be available in both printed form and lighted display form. A keypad is preferably provided to allow the operator of the system to readily access the status information and communicate with the control system.

DETAILED DESCRIPTION OF THE PREFERRED EMBODIMENT

Figure 2:
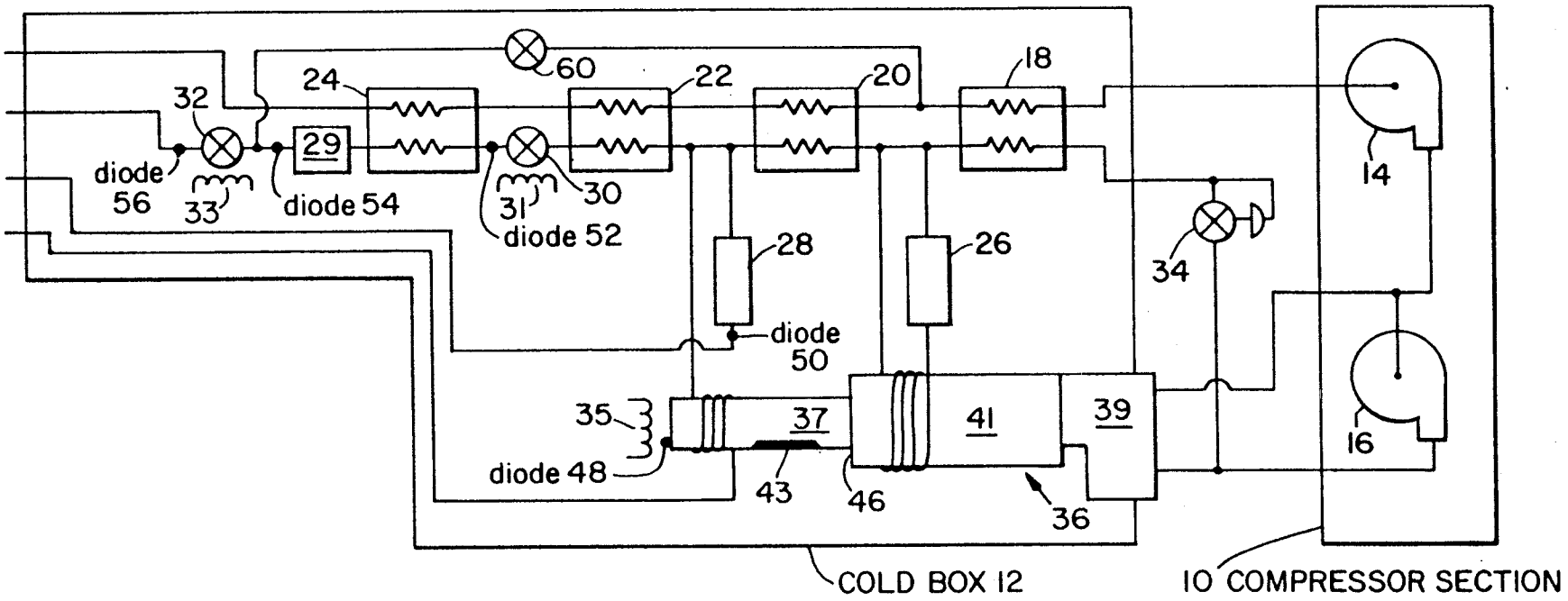
FIG. 2 shows the compressor section and cold box in detail.

In the preferred embodiment of the present invention, a control system 70 (FIGS. 3A and 3B) controls operation of a cryogenic recondenser 2 (FIG. 2). In particular, it displays important status information concerning the cryogenic recondenser 2 that is useful to an operator of the recondenser 2. The control system 70 also automates the initialization routine of the recondenser 2 that the recondenser 2 performs when it is powered up. In addition to automating the initialization of the recondenser 2, the control system 70 automatically shuts down the recondenser 2 in the event that operational limits of the status information exceed safe ranges. Furthermore, it allows for selective activation of heaters used to unclog Joule-Thomson (J-T) valves.

Figure 1:
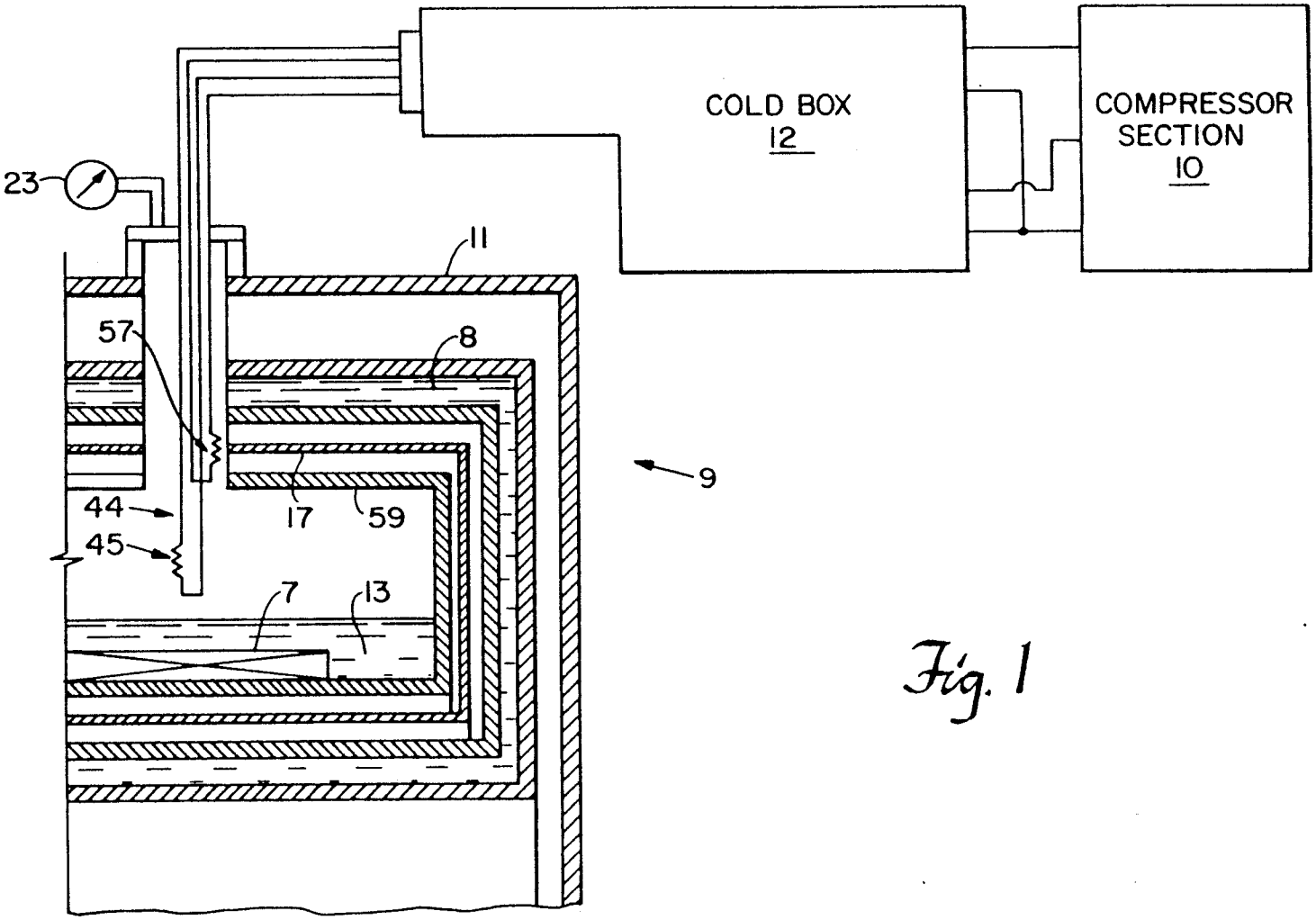
FIG. 1 shows the cryogenic recondenser system.

FIG. 1 shows a cryogenic recondenser system of the preferred embodiment of the present invention. The illustrated recondenser system comprised of a cold box 12 and a compressor section 10 provides refrigeration in a cryostat 59 which retains a bath of liquid cryogen 13 (i.e. helium). The liquid cryogen 13 is used in cooling the magnet 7 of the MRI system 9. In such a system 9, an annular shaped vacuum jacketed structure 11 houses the superconducting magnet 7. As the MRI system is used, the magnet 7 is cooled in the bath of liquid helium retained in the crystat 59. Heat radiating from the walls of the structure 11 which are at room temperature is absorbed by a bath of liquid nitrogen 8 which encompasses the cryostat 59. In addition, a radiation shield 17 is provided to reduce the transfer of heat from the bath of liquid nitrogen 8 to the cryostat 59.

As the MRI system 9 operates, heat is absorbed by the pool of liquid cryogen 13. When a great enough quantity of heat is absorbed, the cryogen in the pool 13 boils-off and rises. This boiled-off cryogen then contacts a recondensing surface 45 located above the pool 13 that absorbs the heat of the boiled-off cryogen. As the heat is absorbed, the cryogen recondenses on the recondensing surface 45 and drips back into the pool of liquid cryogen 13 so as to replenish the liquid inventory 13, FIG. 2 depicts the major components of the cryogenic recondenser 2 of the present invention in more detail. Within the cryogenic recondenser 2, a volume of working refrigerant gas (i.e. helium) is employed. The refrigerant gas enters a first stage compressor 14 inside the compressor section 10, where the gaseous refrigerant is compressed from a pressure of approximately one atmosphere to a pressure of approximately seven atmospheres. The second stage compressor 16 subsequently compresses the refrigerant gas to an even greater pressure of approximately twenty atmospheres. This high pressure refrigerant gas then exits the compressor section 10 and flows to the cold box 12. The compressed refrigerant gas is regulated by a regulator valve 34 that controls the flow of gas into the J-T loop of the cold box 12. Since the pressure of the refrigerant gas in the cold box 12 is related to the flow of the refrigerant gas in the cold box 12, it follows that the regulator valve 34 controls the pressure of the refrigerant gas as it enters the cold box 12. The valve 34, therefore, also controls the refrigerative capacity of the system because the pressure of the refrigerant gas is a primary determinant of refrigerative capacity.

After the refrigerant gas passes through the regulator valve 34, it enters a first heat exchanger 18. The refrigerant gas subsequently flows through heat exchangers 20, 22 and 24 as will be described in more detail below. These heat exchangers 18, 20, 22 and 24 are all counter-flow heat exchangers. Heat from the high pressure warm refrigerant gas flowing through the heat exchangers 18, 20, 22 and 24 in the incoming direction is cooled by lower pressure cool refrigerant gas flowing through the heat exchangers 18, 20, 22 and 24 in the outgoing direction.

This counter-flow cooling of the pressurized refrigerant gas by the first heat exchanger reduces the temperature of the incoming gas to about 77 K. The incoming gas then exits the heat exchanger 18 and travels through a carbon adsorber 26 to purify the gas. Once the gas has been purified by the adsorber 26, it is further cooled by the first stage heat station of the Gifford-MacMahon (G-M) refrigerator 36. The G-M refrigerator 36 uses a portion of the compressed gas taken from the second staged compressor 16 and returned between the two compressor stages 14 and 16. It generates cold by passing the compressed gas through a regenerator matrix and expanding the gas by means of a two stage displacer that displaces with respect to the cold finger 37 using a rotary motor 39. The G-M refrigerator 36 cools heat stations 41 and 43 to about 60 K and 20 K, respectively. The refrigerant gas is cooled by passing the refrigerant through a coil that surrounds the first heat station 41. Specifically, the refrigerant gas is cooled when the first heat station 41 absorbs some of the heat in the refrigerant gas as the refrigerant gas passes by the first heat station 41.

The refrigerant gas continues on to the second heat exchanger 20 where it is cooled to a temperature of approximately 15 K by the second heat exchanger 20. The second heat exchanger 20, like the first heat exchanger 18, is followed by an adsorber 28. The adsorber 28 serves the same role as its predecessor, that is to cleanse the refrigerant gas of any contaminants that, if allowed to remain, might freeze and clog the J-T valves. The cooled refrigerant gas leaving the adsorber 28 then flows into the stinger 44 situated above the cryogen held in the cryostat 59. As described in U.S. Pat. No. 4,766,741, the stinger 44 is a set of transfer lines that are inserted into the cryostat 59. The refrigerant gas from adsorber 28 flows to a heat exchanger 57 on the stinger 44. Heat exchanger 57 cools radiation shield 17 that surrounds the cryostat 59 to reduce heat transfer to the cryogen pool 13.

After cooling the radiation shield 17, the refrigerant gas travels back to the second stage heat station 43 of the G-M refrigerator 36. It flows through a heat exchanger coil that surrounds the second stage heat station 43. By traveling through this heat exchanger coil, the gas is cooled even further. The gas subsequently travels to heat exchanger 22 where it is cooled by the returning counter-flowing cool gas. Upon exiting heat exchanger 22, the gas enters a J-T valve 30 which expands the gas to cool it even further.

The flow areas to the J-T valves 30 and 32 used in the preferred embodiment are set at very small dimensions due to the low mass flow, the high pressure and the low temperature of the working refrigerant gas. A problem that occurs frequently with Joule-Thomson valves is freezing of contaminant gases at the valves. To overcome this problem, the preferred embodiment of the present invention utilizes localized heaters in addition to adsorbers. The localized heaters are selectively activated by the control system 70 to melt any contaminant gases that freeze at the J-T valves. The operation and control of the heaters will be discussed in more detail below.

Having passed through the J-T valve 30, the refrigerant passes through another counter-flow heat exchanger 24. Upon exiting this heat exchanger 24, the refrigerant passes through a third adsorber 29 which is provided to minimize the quantity of contaminant gases that pass through the second J-T valve 32. The second J-T valve 32 is positioned in the flow path of the refrigerant as the refrigerant exits the third adsorber 29. As mentioned previously, a looalized heater 33 is provided for the J-T valve 32.

The refrigerant gas is cooled to a temperature of about 4.4 K by the time it exits the second J-T valve 32. At that temperature, the refrigerant is no longer a gas but becomes instead a two phase fluid. The flow path directs the refrigerant back into the stinger portion 44 of the cryogenic recondenser 2. The extremely cold refrigerant is used to recondense the boiled-off cryogen that it is exposed to the stinger portion 44. In particular, the refrigerant flows in a heat exchange relationship with a recondensing surface of a heat exchanger 45. The extreme cold of the refrigerant thermally communicates with the boiled-off cryogen gas on the other side of the recondensing surface 45. The extreme cold causes the boiled-off cryogen gas to recondense on the recondensing surface 45 and to drip back into the original pool 13 of cryogen from which it evaporated.

The refrigerant then leaves the stinger portion 44 of the cryogenic recondenser 2 and travels back through the counter-flow heat exchangers 24, 22, 20 and 18. When traversing this path, the refrigerant acts to cool the incoming gas. As a result, the refrigerant exiting the stinger portion 44 of the cryogenic recondenser 2 is heated, and the incoming gas is cooled. These counter-flow heat exchangers 18, 20, 22 and 24 are designed so that the net result of their action is to produce a very small temperature difference between the refrigerant and the incoming gas. Once the refrigerant exits the heat exchanger 18, it travels back to the compressor section 10, and the entire cycle is repeated.

Figure 3A:
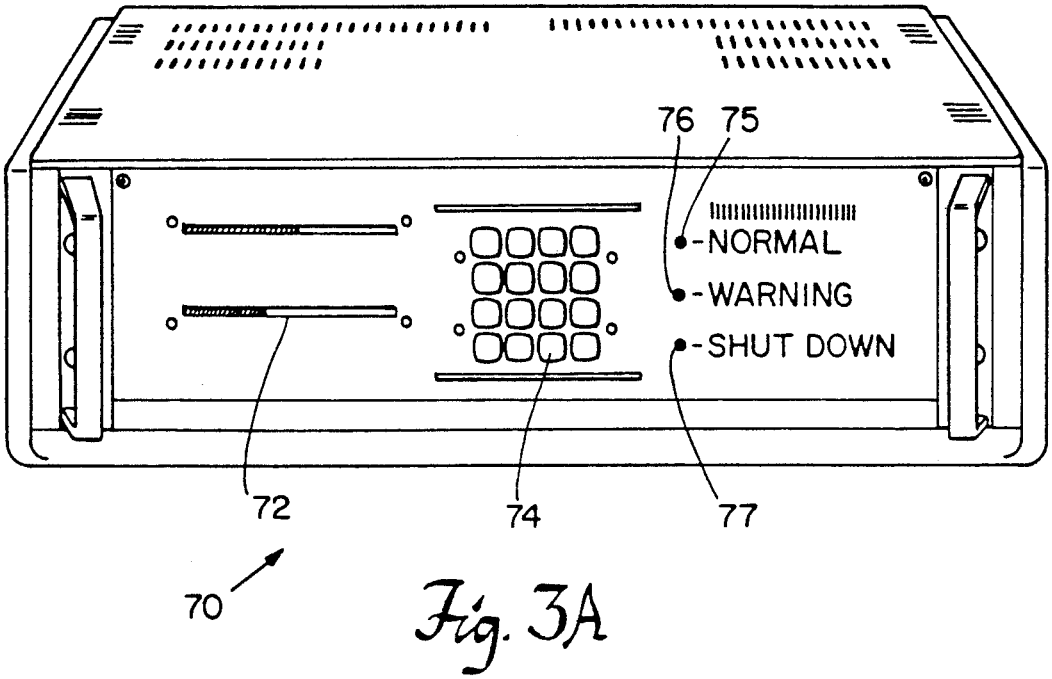
FIG. 3A and 3B show the control system.
Figure 3B:
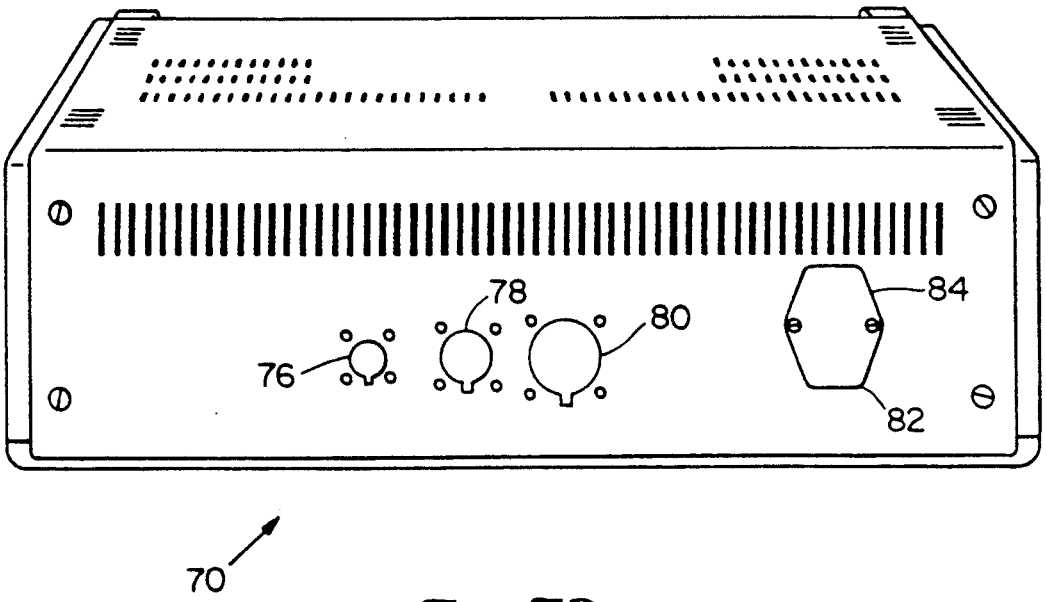

The control system 70 controls operation of the reconder 2. FIGS. 3A and 3B show a front and a rear view of the control system 70, respectively. As can be seen from FIG. 3A, the control system 70 includes a message display 72 and a keypad 74. In addition, a set of status lights 75, 76 and 77 are provided to relay to the operator the current status of the recondenser 2. The green normal light 75 indicates that normal operating conditions exists. The yellow warning light 76, however, indicates a problem exists that needs to be called to the operator's atteuation. The particular condition that caused the warning light to be lit is identified by a code shown in the message display 72. Table 1 (below) lists the warning message codes. The red shutdown light 77 indicates that a condition has reached a critical stage that exceeds the operating parameters of the recondenser and presents a message explaining the cause of the shutdown in the message display 72. Table 2 lists the messages and their cause for display. Moreover, printed output relating to status information can be obtained by coupling the control system 70 to a data processing system such as a personal computer.

TABLE 1

| Yellow Light Display | Cause |
|---|---|
| A | Recondenser in cooldown routine with bypass open. |
| B | Recondenser in cooldown routine with bypass closed. |
| C | Cooling water temperature nearing 100° F. |
| D | Compressor environment temperature is near 120° F. |
| E | Compressor environment temperature is near −25° F. |
| F | Compressor current is near high limit. |
| G | Compressor current is near low limit. |
| H | Heater for pressure control is not functional. |
| I | Heater for pressure control is not controlled. |
| J | Cryostat pressure is in excess of 7 psig. |
| K | Heater H2 or H3 has been manually activated. |

TABLE 2

| Red Light Display | Cause |
|---|---|
| Water out of spec. | Cooling water temperature is warmer than 102.5° F. or cooler than 47.5° F. |
| Ambient out of spec. | Ambient temperature is warmer than 120° F. or colder than −25° F. |
| Cooldown Failure A | Cooldown A routine failed to complete within 10 hours. |
| Cooldown Failure B | Cooldown B routine failed to complete within 6 hours. |
| Poor vacuum | Vacuum within cold box exceeded 100 microns. |
| Current out of spec. | Compressor current is less than 5 amps or greater than 25 amps. |
| Low Magnet Pressure | Magnet pressure is less than 0.2 psi. |
| | Recondenser has excessive capacity, cryostat is venting, or magnet burst disc has ruptured. |

At the rear of the control system 70 as shown in FIG. 3B, is an electrical connector 71, a compressor connector 78 and a cold box connector 80. Also at the rear Of the box is an on/off switch 84 and an input power connector 82. Through these connectors, the control system 70 is interfaced with the components of the recondenser 2 so as to allow it to automatically monitor and control the recondenser 2. In particular, the cold box connector 80 connects the control system 70 to the cold box 12 of the recondenser 2, and the compressor connector 78 enables electronic communication between the compressor section 10 of the recondenser 2 and the control system 70. The input power connector 82 allows the control system 70 to be connected to a power source.

The control system 70 includes a microprocessor for assisting in the automation of its functions. This microprocessor executes a number of software routines that direct the control system 70 to react to different circumstances. Moreover, the software routines also enable the microprocessor to monitor critical conditions of the recondenser 2 and automate the initialization routine. The operations performed by these software routines are described in more detail below.

One of the primary functions of the control system 70 is to monitor temperature at different points in the cryogenic recondenser 2. To provide for such a capability, a plurality of temperature sensing diodes are placed at strategic locations within the cryogenic recondenser 2. Specifically, a diode 46 is placed at the first stage of the G-M refrigerator 36, and a diode 48 is placed at the second stage of G-M refrigerator 36. Likewise, diodes 52 and 56 are situated at the respective J-T valves 30 and 32. Lastly, diodes 50 and 54 are situated at the second adsorber 28 and the third adsorber 29 to measure temperature of the refrigerant gas as it exits said adsorbers 28 and 29. The control system 70 utilizes these diodes to monitor conditions so as to actively control operation of the cryogenic recondenser 2 as well as to provide relevant status information to the recondenser operator.

The control system 70 also includes a transducer 23 situated in the cryostat 59 to provide the operator of the cryogenic recondenser 2 with the ambient pressure of the cryostat 59. The control system 70 provides the capability to display such cryostat pressure readings. There are several reasons why the operator wants to know what the cryostat pressure is at any given time. First, the operator wants to know if the cryostat pressure gets too high because it means that either the recondenser 2 is not adequately performing its job or the magnet 7 is being energized. Second, an operator wants to know if the pressure differential between the cryostat 59 and the outside environment is too low, because when it is too low the outside environment contaminants tend to leak into the cryostat 59.

Figure 4:
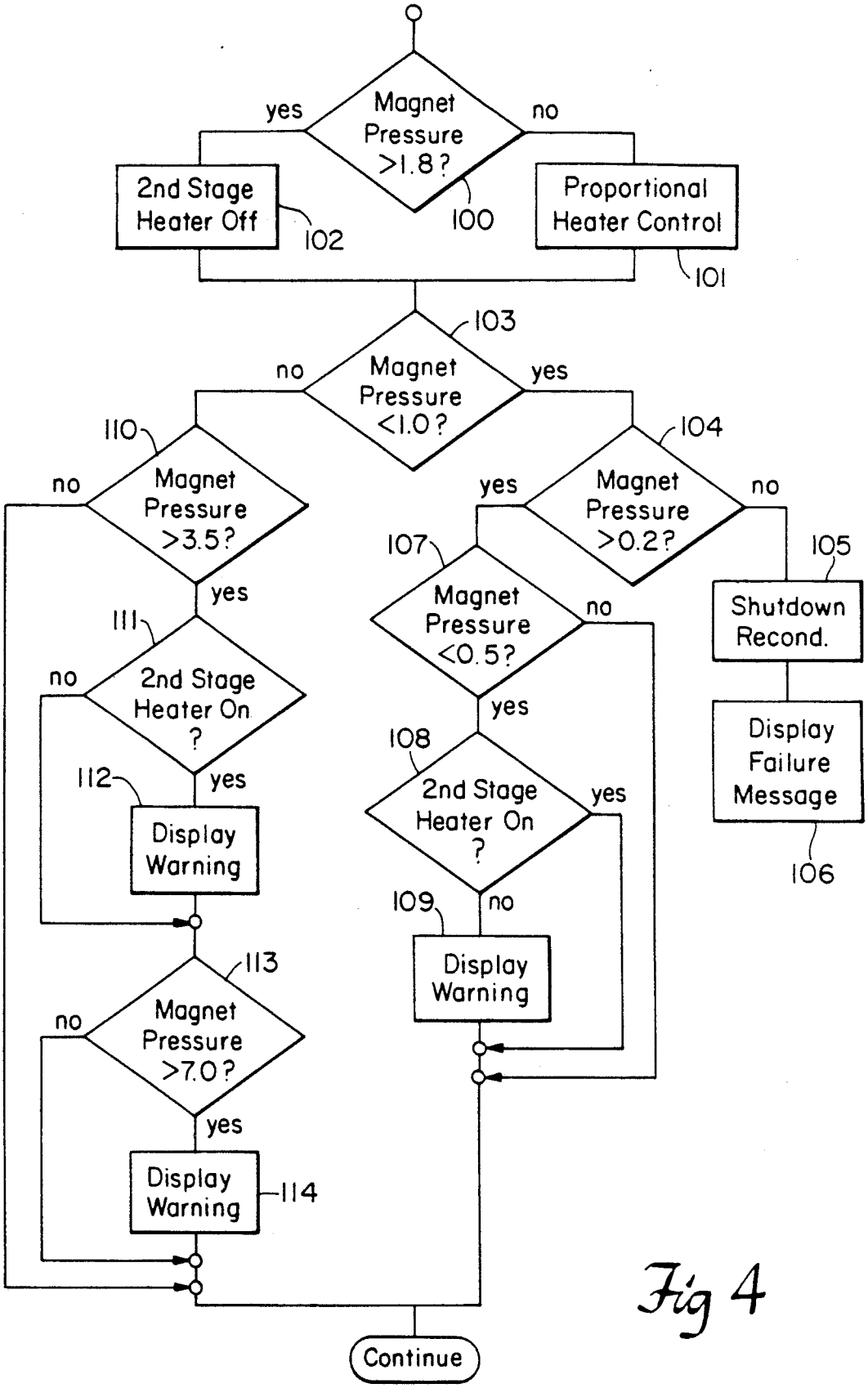
FIG. 4 shows a flow chart of how the control system monitor a reacts to cryostat pressure.

Part of the software of the control system 70 monitors the pressure within the cryostat. A flowchart of the steps performed by the software is shown in FIG. 4. Specifically, the control system 70 tries to maintain a pressure of 1.0 psig within the cryostat 59. To maintain this pressure level, the control system 70 first checks to see whether the magnet pressure is greater than 1.8 psig (step 100). If the pressure is not greater than 1.8 psig, the control system 70 turns on the proportional heater 35 at the second stage of the G-M refrigerator 36 (step 101). This heater 35 can vary the amount of heat it generates. As more voltage is applied to the heater 35, a greater the amount of heat is produced. If, however, the pressure is greater than 1.8 psig, the heater 35 is turned off (step 102). Having set the heater 35 appropriately, the control system 70 then checks to see if the magnet pressure is less than 1.0 psig (step 103).

If the magnet pressure is less than 1.0 psig, the control system checks to see if the magnet pressure is even less than 0.2 psig (step 104). If the magnet pressure is below 0.2 psig, the control system 70 shuts down the recondenser 2 (step 105) and displays the appropriate message (step 106). Such a low magnet pressure indicates that the recondenser 2 is either cooling too much, that the cryostat system is vented or that the magnet's burst disc has ruptured. If, on the other hand, the magnet pressure does exceed 0.2 psig, the control system determines whether the pressure is less than 0.5 psig (step 107). In the case that magnet pressure is less than 0.5 psig, the control system asks whether the heater 35 at the second stage of the refrigerator 36 is on (step 108). If the answer is that the heater 35 is not on, then the system displays a warning, for it means that the heater was not turned on as it should have been at given the current pressure level (step 109) or that there is an open circuit that is preventing the heater from operating properly. However, if the heater 35 is on or if the magnet pressure is not less than 0.5 psig, the control system leaves the heater 35 in its current state.

If the pressure as initially checked in step 103 was greater than 1 psig, the control system 70 checks to see if the pressure is greater than 3.5 psig (step 110). If it is not greater than 3.5 psig, the pressure is within the acceptable range. In contrast, if the pressure is greater than 3.5 psig, the control system checks if the heater 35 is on for it should be off at such a pressure level (step 111). If the heater 35 is on, the control system 70 indicates a warning (step 112). Regardless of whether the heater 35 is off or on, the control system 70 then checks to see if the pressure exceeds 7.0 psig (step 113). when the pressure exceeds this threshold, a warning is indicated (step 114). The pressure may, nevertheless, continue to rise. In fact, the pressure can at times rise to lie within a range between 12 to 15 psig if the magnet is being turned on or off. The warning light is an indicator that the situation should be monitored for possible action by the operator.

The control system 70 also provides the capability of automating the initialization procedure for the cryogenic recondenser 2. This procedure is initiated whenever the recondenser 2 is powered up or upon regaining power after the loss of power. It is initiated manually by switching the on/off switch 84 to the "ON" position. For purposes of this discussion it is assumed that the recondenser 2 is starting at room temperature or in a warm state. To operate efficiently, the recondenser 2 must cool-down to a temperature at the level specified in the above discussion. It achieves this temperature by using an initialization cooling procedure. This procedure can last up to a maximum of sixteen hours. The control system 70 automates this initialization procedure in several ways.

Figure 5A:
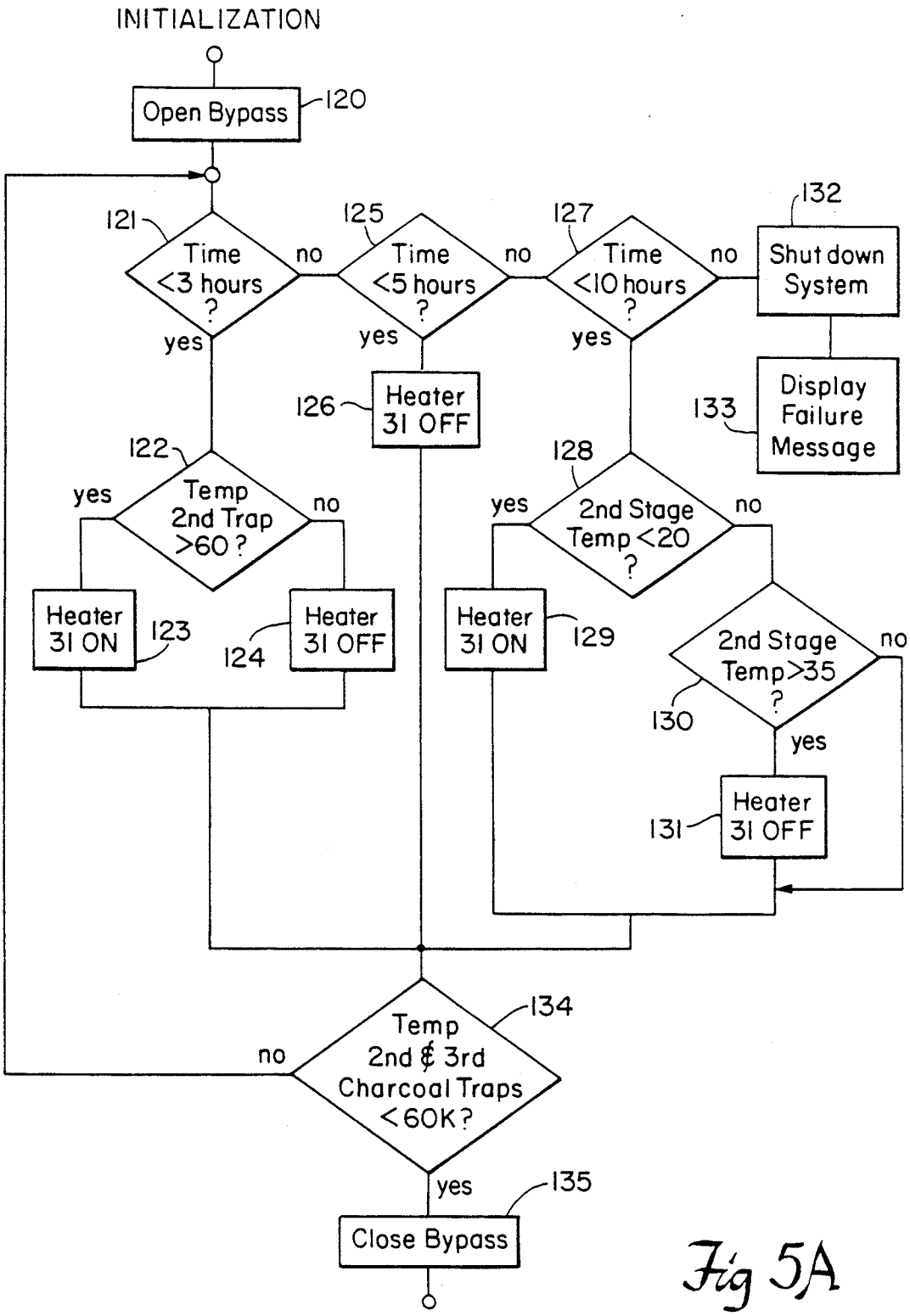
FIG. 5A and 5B show is a flow chart of the initialization routine.
Figure 5B:
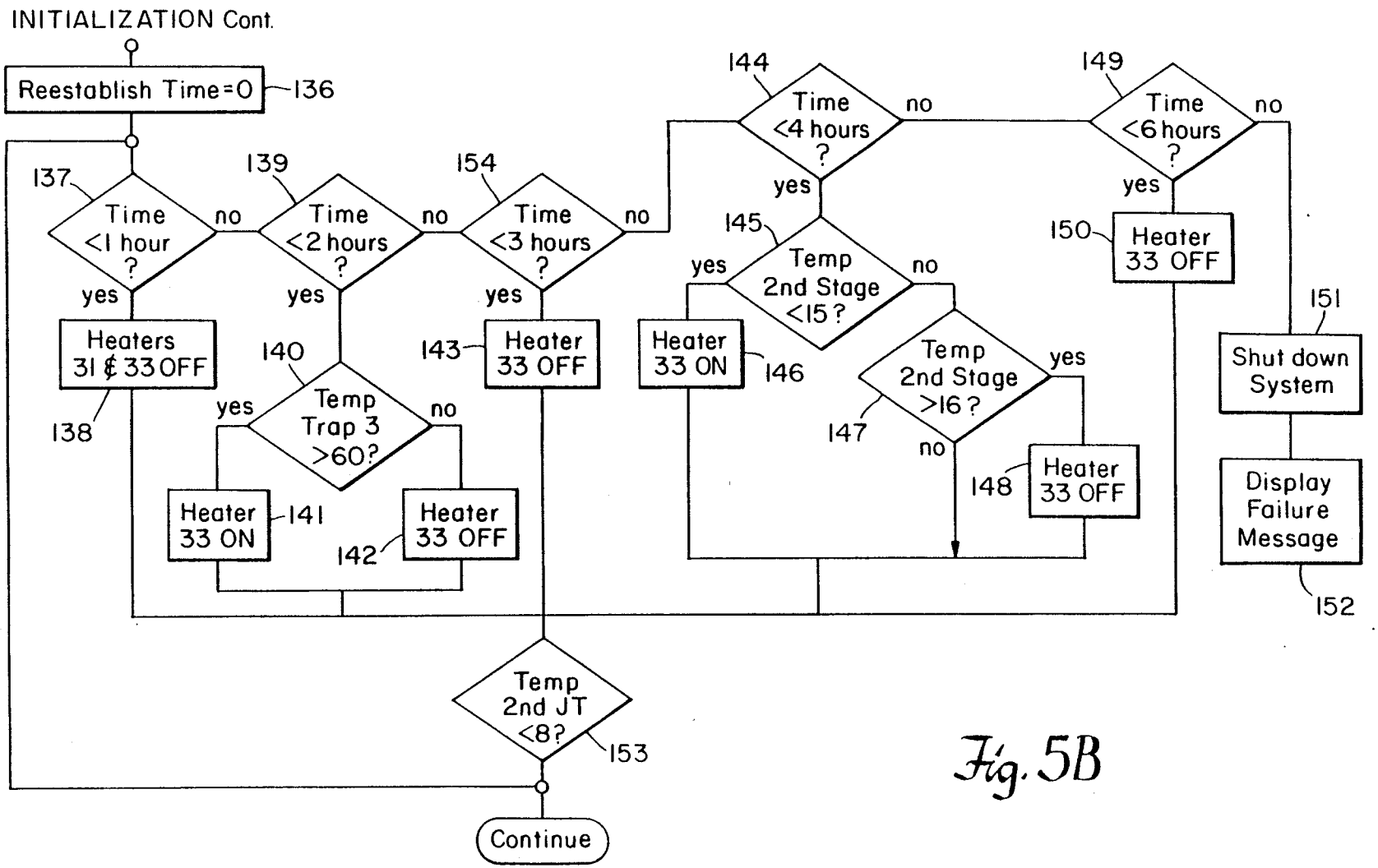

FIGS. 5A and 5B shows the basic steps of the initialization routine. As can be seen in FIG. 5A and 5B, one step in the initialization procedure is to open the bypass valve 60 (step 120 in FIG. 5A). This bypass valve 60 prevents the refrigerant from flowing back through the counter-flow heat exchangers 20, 22, and 24 in the return path. Instead, it directs the refrigerant to flow through a loop that bypasses all of these heat exchangers 20, 22 and 24. The reason for opening this bypass path is to accelerate the cooling of the heat exchangers 20, 22, and 24. If the gas is allowed to return back through the heat exchangers 20, 22 and 24, it is more difficult for the heat exchangers to reach the proper cooling level because the refrigerant that flows back through the heat exchangers is not cool enough yet to produce the desired cooling effect.

The control system 70 also switches on the J-T heaters 31 and 33 during the initialization routine. In particular, during the first three hours of the initialization routine (see step 121), the heater 31 is turned on (step 123) if the temperature at the 2nd adsorber 28 is greater than 60 K (as checked in step 122), and the heater is turned off (step 124) if the temperature is less than or equal to 60 K. The reason for turning on the heater 31 is that the adsorbers 26, 28 and 29 which would usually adsorb contaminant gases in the cryogenic recondenser 2 are not yet cool enough to effectively filter out such contaminants. As a result, the contaminant gases are prone to freeze at the J-T valve 30. The heater 31 prevents this freezing. Moreover, little cooling effect is lost by activating heater 31, for the J-T valve 30 provides a minimal amount of cooling at this temperature. The J-T valve 30 is primarily effective only at lower temperatures.

At the end of the three hour period, heater 31 is turned off (step 126) for a two hour period (see step 125). In the final portion of this initial cooling period wherein the time is less than ten hours as checked in step 127, the heater 31 is selectively turned on as a function of time and system temperatures. If the temperature reading from the diode 48 at the second stage of the G-M refrigerator 36 indicates a temperature less than 20 K (see step 128), it may mean that the first J-T valve 30 is clogged, because when the first J-T valve 30 is clogged none or only a portion of the warm gas flows past the second stage to raise the temperature up above 20 K. To clear the blockage, the heater 31 at the J-T valve 30 is turned on (step 129). If however, the temperature at the second stage of the refrigerant 36 is not less than 20 K, the control system 70 checks to see if the temperature at the second stage is greater than 35 K (step 130). If it is greater than 35 K, the heater 31 is turned off (step 131).

Once the temperature sensing diodes 54 and 50 indicate temperatures of less than 60 K (step 134), the adsorbers 28 and 29 are at acceptable operating temperatures, and the bypass valve 60 is closed (step 135). This may occur any time within the first ten hours of cool down. If, however, these temperatures are not attained within this ten hour time frame (see step 127), the system is shut down (step 132), and the message "Cool-down Failure A" is displayed (step 133). The closing of the bypass valve 60 marks the beginning of a second phase of cool-down, and the time is reset to its initial value (step 136).

In the first hour of this second phase of cool-down (step 137), the heaters 31 and 33 are turned off (step 138). During this phase of cool down, the control system 70 is no longer concerned with freezing at the first J-T valve 30 because the temperature at the second adsorber 28 is low enough to adequately cleanse any contaminants from the refrigerant gas that might freeze at the first J-T valve 30. At this point the second J-T valve 32 is still warm and blockage of the J-T valve 32 is not yet of concern. During the second hour of this phase (see step 139), the temperature at the third adsorber 29 is monitored (step 140). If the adsorber 29 is warmer than 60 K, the heater 33 is turned on (step 141), and if it is colder than 60 K the heater is turned off (step 142). In the third hour of this phase (see step 154), both heaters 31 and 33 are off (step 143).

During the fourth hour of this phase (see step 144), the temperature at the second stage of the refrigerator 36 as measured by the diode 48 is monitored (step 145). A temperature below 15 K as checked in step 145 indicates that the second J-T valve 32 has become blocked by contaminants. To remedy this problem, the heater 33 at the second J-T valve 32 is turned on to clear the blockage (step 146). In this phase of operation, J-T valve 30 will not become blocked because adsorber 28 is at its proper operating temperature. Once the temperature measured at the second stage of the refrigerator 36 exceeds 16 K while the heater 33 is on (see step 147), it is an indication that the problem has been corrected. Hence, the heater is turned off (step 148) to prevent too much heat from being put back into the system.

During the fifth and sixth hours of this phase if the phase lasts that long (see step 149), the heater 33 is turned off (step 150). Should this phase continue for more than six hours, meaning that the stinger does not reach a temperature of less than 8 K, the recondenser 2 is shut down (step 151), and the failure message is displayed (step 152).

A critical threshold temperature for the recondenser is 8 K (see step 153). Specifically, when the recondenser reaches 8 K cool down is complete. It would be preferable to not halt cool down until the temperature is at 4.4 K. The temperature of 8 K as measured by the diode 56 was chosen as an alternate threshold because of the accuracy error of the temperature readings at such extremely low temperatures. The control system 70 is assured that it has reached a temperature of 4.4 K even though the diode 56 reads 8 K when the pressure indicated at the transducer in the cryostat 59 does not rise. This is an accurate indicator of reaching 4.4 K, for if the temperature exceeded 4.4 K, more energy would flow into the magnet 7 than could be taken out by the cryogen 13. The excess energy would result in boil-off and accordingly, an increase in pressure. The absence of such increasing pressure indicates the absence of excess energy.

Figure 6:
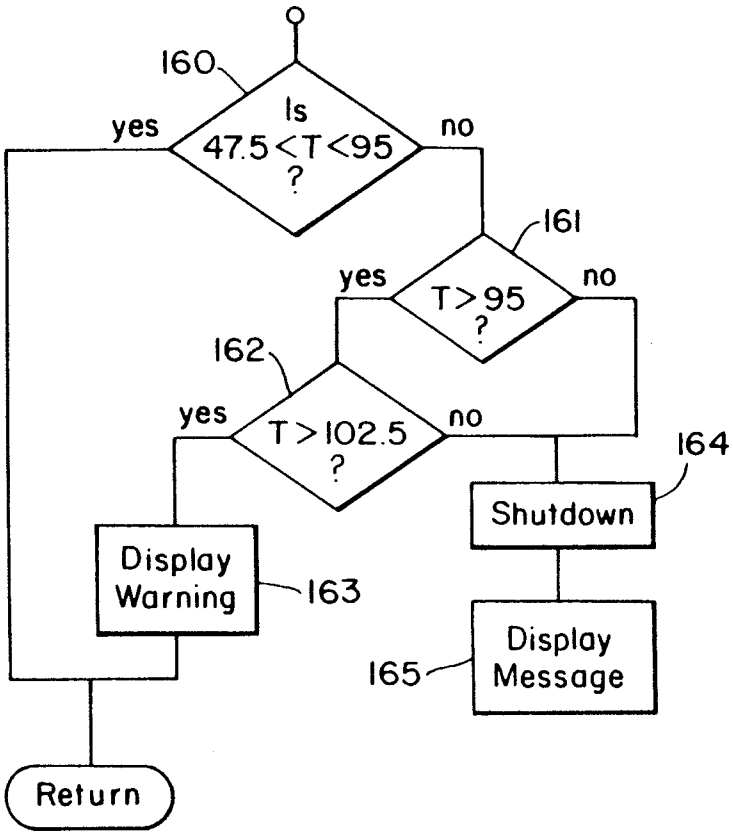
FIG. 6 shows a flow chart of how the control system monitors and reacts to water temperature.

The control system 70 also responds to the temperature of the water that cools the compressor portion 10 of the recondenser 2. FIG. 6 shows how the software of the control system 70 monitors the temperature. First, it checks to see if the water temperature lies between 47.5° F. and 95° F. (step 160). If the temperature lies within this range, the water temperature is acceptable. However, if the water temperature is not within this range, the control system 70 checks to see whether the water temperature exceeds 95° F. (step 161). If less than 95° F. and not in the range checked above, the water temperature must be inordinately low and thus, the temperature indicates a severe problem requiring that the recondenser be shut down (step 164) and that a message displayed (step 165). On the other hand, if the water temperature is greater than 95° F., the control system checks to see if the temperature is less than or equal to 102.5° F. (step 162). Should the temperature exceed 102.5° F., the recondenser 2 is shut down (step 164). However, if the temperature does not exceed 102.5° F. (i.e. it lies between 95° F. and 102.5° F.), a warning is indicated (step 163) by lighting the warning light 76 and displaying the appropriate code on the message display 72.

Figure 7:
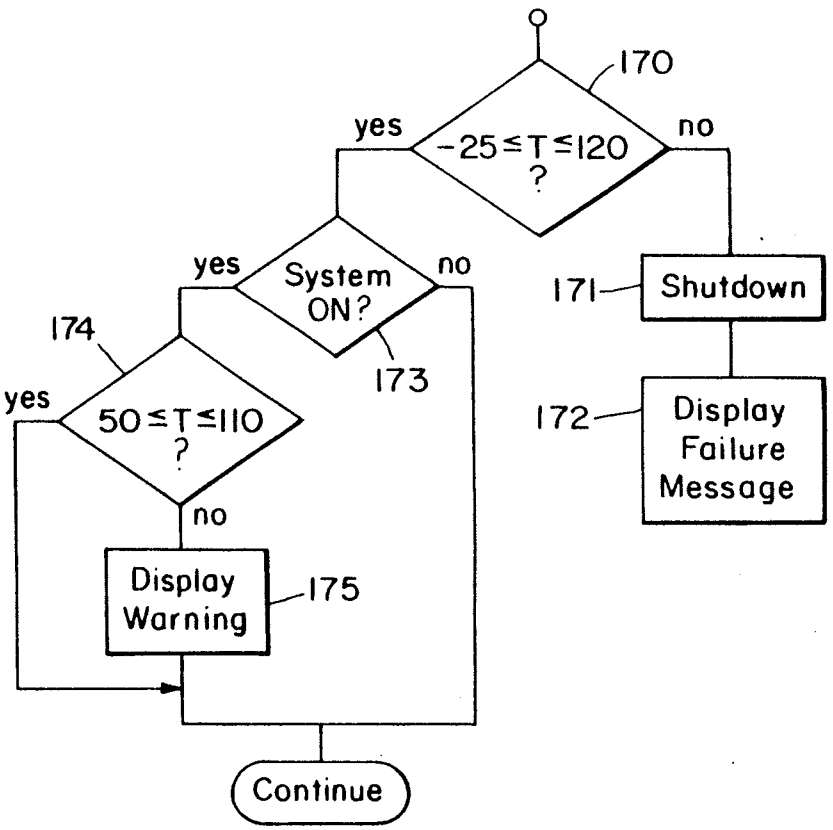
FIG. 7 shows a flow chart of how the control system monitors and reacts to ambient air temperature.

The ambient air temperature around the compressor section 10 is also monitored. FIG. 7 reveals the steps performed by the software of the control system regarding the ambient air temperature. Specifically, the control system checks to see if the air temperature is in the range between −25° F. and 120° F. (step 170). When ambient air temperature lies outside this range, the control system 70 either refuses to start the recondenser 2 or, if it is already operating, the control system 70 shuts down the system (step 171) and displays a failure message (step 172). Similarly, if the recondenser is running (see step 173), and the ambient temperature is either greater than 110° F. or less than 50° F. (see step 174), the warning light 76 is lit and a message code is displayed (step 175).

Figure 8:
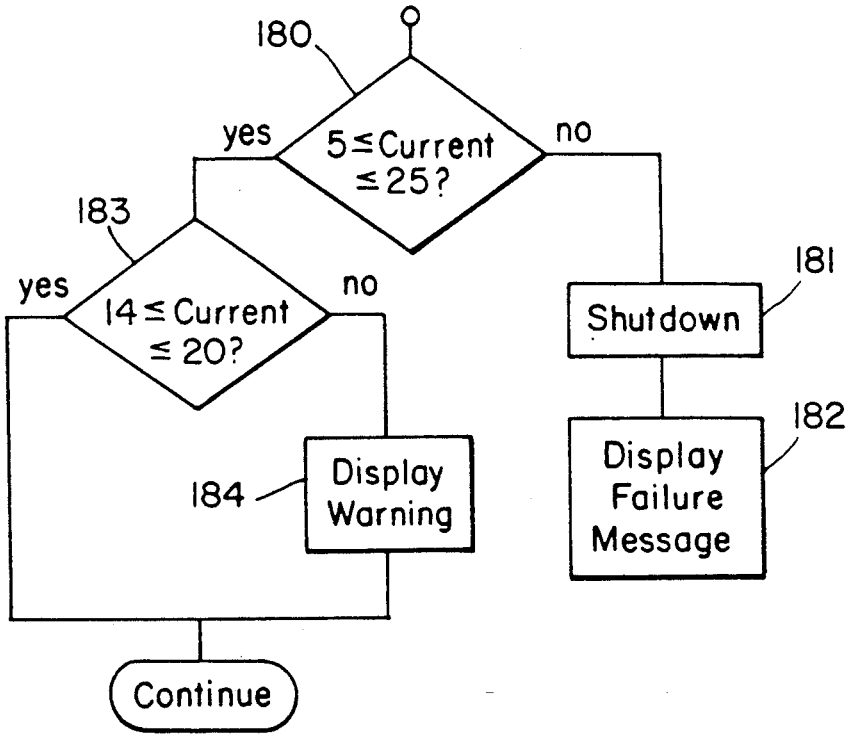
FIG. 8 shows a flow chart of how the control system monitors and reacts to compressor section current.

The final critical condition monitored by the control system is current to the compressor section 10. FIG. 8 shows the basic steps performed by the software of the control system 70 in this regard. For the compressor section 10 to operate properly, the current must be in the range of 5 to 25 amperes. The control system checks to see if the current lies within this range (step 180). If it does not, the system is shut down (step 181) and a failure message is displayed (step 182). Further, even if the current is within the range, the control system 70 checks to see if the current lies between 14 to 20 amperes (step 183). If it is not within this range a warning is indicated (step 184).

The control system 70 is provided with a keypad so as to facilitate interaction between the recondenser operator and the control system 70. For instance, the keypad 74 may be used by the operator after cool-down has been completed to allow the operator to turn the heater at a J-T valve on for ten minutes. This short term heating is used to unblock the J-T valves if they become frozen during normal operation.

Moreover, the keypad allows the operator access to monitored information. As can be seen in FIG. 3A, each of the keys in the keypad 74 is labelled with code letters. The code letters correspond to status information that may be obtained by the operator using the keypad 74. In particular, to get desired status information, the operator presses the key associated with the desired status information. For example, if the operator wanted to know the ambient air temperature, he would push the key "ENTER". Once the control system 70 responded by displaying a message, the operator would press the key labelled "TA". Table 3 shows all of the keypad codes and the status information they are associated with.

TABLE 3

| Keypad | Information Displayed | |
|---|---|---|
| TA | Ambient air temperature | (F.) |
| TW | Water discharge temperature | (F.) |
| T1 | First stage temperature | (K.) |
| T2 | Second stage temperature | (K.) |
| T3 | Stinger (2nd J-T) temperature | (K.) |
| C2T | Second adsorber temperature | (K.) |
| C3T | Third adsorber temperature | (K.) |
| JT1 | First J-T temperature | (K.) |
| CI | Compressor Current | (amps) |
| H1 | Power to 2nd stage heater | (watts) |
| H2 | Power to 1st J-T heater | (watts) |
| H3 | Power to 2nd J-t heater | (watts) |

While the invention has been particularly shown and described with reference preferred embodiments thereof, it will be understood by those skilled in the art that various changes of form and details may be made without departing from the spirit and scope of the invention as defined in the appended claims.

We claim:

1. A cryogenic refrigeration system, comprising:

(a) a path through which a refrigerant flows;

(b) at least one Joule-Thomson valve positioned in the path through which the refrigerant flows for cooling the refrigerant;

(c) at least one heater positioned near the at least one Joule-Thomson valve for heating the at least one value to remove blockage caused by freezing of contaminants at the at least one valve; and (d) a temperature sensor to measure a temperature in the system to determine when to turn on the at least one heater.

2. A cryogenic refrigeration system as recited in claim 1 wherein the system is a cryogenic recondenser for recondensing refrigerant gas to refrigerant liquid.

3. A cryogenic refrigeration system as recited in claim 1 wherein a separate heater is provided for each Joule-Thomson valve.

4. A cryogenic refrigeration system as recited in claim 1 wherein a sensor is situated at each J-T valve.

5. A cryogenic refrigeration system as recited in claim 1 further comprising a closed-cycle refrigerator to cool the refrigerant.

6. A cryogenic refrigeration system as recited in claim 5 wherein a sensor is situated at a refrigerator of the cryogenic refrigeration system.

7. A cryogenic refrigeration system as recited in claim 1 wherein the refrigerant is hellium.

8. A cryogenic refrigeration system as recited in claim 1 wherein the sensors are temperature sensing diodes.

9. A cryogenic refrigeration system as recited in claim 1 further comprising at least one adsorber situated in the path through which the refrigerant flows for cleansing the refrigerant.

10. A cryogenic refrigeration system as recited in claim 9 wherein sensors are positioned after the at least one adsorber to measure the temperature of refrigerant exiting the adsorber.

11. In a cryogenic refrigeration system, a method of preventing blockage of a Joule-Thomson valve caused by freezing of contaminants, comprising the steps of:

(a) monitoring temperature in the system using a sensor; and (b) heating the Joule-Thomson valve with a heater as dictated by a control system when temperature readings from the sensor indicate that a blockage has occurred at the Joule-Thomson valve due to freezing of contaminants.

12. A method as recited in claim 11 further comprising the step of using the control system to direct the heater to heat the Joule-Thomson valve during a predetermined time period when the cyrogen refrigeration system is powered up.

13. A method as recited in claim 11 wherein the cryogenic refrigeration system is a cryogenic recondenser.

14. A control system for controlling the operation of a cryogenic refrigeration system having a Joule-Thomson valve, comprising:

(a) a heater positioned near said Joule-Thomson valve;

(b) a temperature sensor for sensing temperature in the cryogenic refrigeration system;

(c) a heater controller for selectively controlling the heater positioned near the Joule-Thomson valve, wherein the heater controller responds to temperature readings received from the temperature sensor to regulate the heater.

15. A control system as recited in claim 14 wherein the control system monitors temperature at the Joule-Thomson valve to determine whether the valve is blocked by contaminants.

16. A control system as recited in claim 14 wherein the control system automatically turns on the heater during a start up routine.

17. A control system for controlling the operation of a cryogenic refrigeration system comprising (a) a starting means for initializing the cryogenic refrigeration system upon powering up the refrigeration system;

(b) a display means for displaying status information;

(c) a shutdown means for shutting down the refrigeration system in response to certain conditions; and (d) a heater control means for controlling the operation of heaters connected to Joule-Thomson valves.

18. A control system as recited in claim 17 wherein the control system initializes the recondenser by activating a bypass valve in the cryogenic refrigeration system to make refrigerant in the refrigeration system follow a bypass path in which the refrigerant will cool more quickly than if the refrigerant did not flow through the bypass path.

19. A control system as recited in claim 17 wherein the control system initializes the refrigeration system by turning on the heaters connected to the Joule-Thomson valves.

20. A control system as recited in claim 17 wherein the display means displays status information indicative of whether critical conditions inside the refrigeration system are within a specified range.

21. A control system as recited in claim 20 wherein the display means displays whether the critical conditions inside the refrigeration system are within a cautionary mode range wherein operational limits of the critical conditions are being approached and whether the conditions are within a failure mode range wherein operational limits of the critical conditions are exceeded.

22. A control system as recited in claim 21 wherein the critical conditions include temperature in the refrigeration system and cryostat pressure.

23. A control system as recited in claim 21 wherein the display means displays in both printed and lighted form.

24. A control system as recited in claim 21 wherein the control system shuts down the refrigeration system if the critical conditions are in the failure mode range.

25. A control system as recited in claim 17 wherein the control system controls the capacity of the refrigeration system.

26. A control system as recited in claim 17 further comprising a keypad that allows an operator of the refrigeration system to communicate with the control system.

27. A control system as recited in claim 26 wherein the operator can gain access to monitored temperatures in the refrigeration system using the keypad.

28. A control system as recited in claim 17 wherein the control system time activates the heaters so that they operate at a given time for a duration.

29. A control system as recited in claim 17 wherein the cryogenic refrigeration system is a cryogenic recondenser.

30. A method of controlling operation of a cryogenic refrigeration system having Joule-Thomson valves and heaters for heating said Joule-Thomson valves, comprising the steps of:

a) initiating a start up routine in response to power being switched on for the cryogenic refrigeration system;

b) displaying monitored temperatures and cryostat pressure;

c) displaying warning signals if the system fails and if dangerous conditions arise;

d) shutting down the refrigeration system if a maximum cryostat pressure level is exceeded;

e) shutting down system if monitored conditions are outside a specified range; and f) activating said heaters of said Joule-Thomson valves in response to monitored conditions indicating blockage of said valves and during the start up routine.

31. A method as recited in claim 30 wherein the cryogenic refrigeration system is a cryogenic recondenser.

32. A method of regulating the temperature of a cryogenic refrigeration system having a cryostat and a closed cycle refrigerator within a Joule-Thomson valve liquification system comprising the steps of:

(a) monitoring cryostat pressure; and (b) using an electric heater, heating a cold finger of the refrigerator when the cryostat pressure becomes too low so as to regulate system temperature.

33. A method as recited in claim 32, wherein the refrigerator is a Gifford-MacMahon refrigerator.

34. A method as recited in claim 32, wherein the refrigerator is a two stage refrigerator.

35. A method as recited in claim 32 wherein the refrigerator is heated by an individual heater situated at the refrigerator.

* * * * *